US011156068B2

(12) United States Patent
Robey et al.

(10) Patent No.: US 11,156,068 B2
(45) Date of Patent: Oct. 26, 2021

(54) REACTIVE PERFORATING GUN TO REDUCE DRAWDOWN

(71) Applicant: Halliburton Energy Services, Inc., Houston, TX (US)

(72) Inventors: Richard E. Robey, Mansfield, TX (US); Brenden Michael Grove, Mansfield, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 181 days.

(21) Appl. No.: 16/524,956

(22) Filed: Jul. 29, 2019

(65) Prior Publication Data

US 2020/0392819 A1 Dec. 17, 2020

Related U.S. Application Data

(60) Provisional application No. 62/861,192, filed on Jun. 13, 2019.

(51) Int. Cl.
*E21B 43/119* (2006.01)
*E21B 43/117* (2006.01)
(Continued)

(52) U.S. Cl.
CPC ..... *E21B 43/119* (2013.01); *E21B 43/116* (2013.01); *E21B 43/117* (2013.01);
(Continued)

(58) Field of Classification Search
CPC ..... E21B 43/11; E21B 43/116; E21B 43/117; E21B 43/1185; E21B 43/1195
See application file for complete search history.

(56) References Cited

U.S. PATENT DOCUMENTS 6,962,634 B2 11/2005 Nielson et al.
7,278,354 B1 10/2007 Langan et al.
(Continued)

FOREIGN PATENT DOCUMENTS

CA 2541174 4/2005
WO WO-2017-131835 8/2017
WO WO-2018034671 A1 * 2/2018 ..... E21B 43/1185

OTHER PUBLICATIONS

"DynaEnergetics Announces Favorable Ruling in Defense Against Patent Infringement Action Brought by GEODynamics", Mar. 6, 2018, 2 pages; https://dmcglobal.com/en/news/DynaEnergetics-Announces-Favorable-Ruling.
(Continued)

*Primary Examiner* — Tara Schimpf
(74) *Attorney, Agent, or Firm* — Haynes and Boone, LLP

(57) ABSTRACT

A perforating gun and method according to which a perforating charge of the perforating gun is detonated. Detonating the perforating charge produces shock waves. In some embodiments, detonating the perforating charge also perforates a wellbore proximate a subterranean formation. After detonating the perforating charge, first and second components of a binary energetic of the perforating gun are fragmented by the shock waves, mixed by the shock waves, and activated by the shock waves to increase an internal energy of the perforating gun. In some embodiments, increasing the internal energy of the perforating gun after detonating the perforating charge delays and/or decreases wellbore pressure drawdown.

19 Claims, 12 Drawing Sheets

(51) Int. Cl.
*E21B 43/116* (2006.01)
*E21B 43/1185* (2006.01)
*E21B 43/11* (2006.01)

(52) U.S. Cl.
CPC ..... *E21B 43/1185* (2013.01); *E21B 43/1195* (2013.01); *E21B 43/11* (2013.01)

(56) References Cited

U.S. PATENT DOCUMENTS

| | | | | |
|---|---|---|---|---|
| 7,393,423 | B2 | 7/2008 | Liu | |
| 7,913,761 | B2 | 3/2011 | Pratt et al. | |
| 8,127,654 | B2 | 3/2012 | Williams et al. | |
| 8,347,962 | B2 | 1/2013 | Sampson et al. | |
| 9,080,431 | B2 | 7/2015 | Bell et al. | |
| 10,151,180 | B2 | 12/2018 | Robey et al. | |
| 2003/0037692 | A1* | 2/2003 | Liu | F42B 1/032 102/301 |
| 2009/0078420 | A1 | 3/2009 | Caminari et al. | |
| 2009/0183916 | A1* | 7/2009 | Pratt | E21B 43/117 175/2 |
| 2010/0132945 | A1* | 6/2010 | Bell | E21B 43/117 166/297 |
| 2010/0319520 | A1 | 12/2010 | Williams et al. | |
| 2011/0000669 | A1 | 1/2011 | Barlow et al. | |
| 2011/0056362 | A1 | 3/2011 | Yang et al. | |
| 2018/0016879 | A1 | 1/2018 | Harive | |
| 2019/0032173 | A1 | 1/2019 | Sherman et al. | |

OTHER PUBLICATIONS

International Search Report and Written Opinion from PCT/US2019/043950, dated Mar. 12, 2020, ISA/KR, pp. 1-11.

* cited by examiner

REACTIVE PERFORATING GUN TO REDUCE DRAWDOWN

CROSS-REFERENCE TO RELATED APPLICATION

This application claims the benefit of the filing date of, and priority to, U.S. Patent Application No. 62/861,192, filed Jun. 13, 2019, the entire disclosure of which is hereby incorporated herein by reference.

TECHNICAL FIELD

The present application relates generally to perforating wellbores, and, more particularly, to perforating guns including reactive components that provide an additional energy source to reduce wellbore drawdown after detonation of perforating charges.

BACKGROUND

Wellbores are typically drilled using a drilling string with a drill bit secured to the lower free end and then completed by positioning a casing string within the wellbore and cementing the casing string in position. The casing increases the integrity of the wellbore but requires perforation to provide a flow path between the surface and selected subterranean formation(s) for the injection of treating chemicals into the surrounding formation(s) to stimulate production, for receiving the flow of hydrocarbons from the formation(s), and for permitting the introduction of fluids for reservoir management or disposal purposes.

Perforating has conventionally been performed by means of lowering a perforating gun on a carrier down inside the casing string. Once a desired depth is reached across the formation of interest and the gun is secured, it is fired. The gun may have one or many charges thereon which are detonated using a firing control, which may be activated from the surface via wireline or by hydraulic or mechanical means. Once activated, each charge is detonated to perforate (penetrate) the casing, the cement, and to a short distance, the formation. This establishes the desired fluid communication between the inside of the casing and the formation.

Typical hollow-carrier perforating guns used in service operations for perforating a formation generally include an elongated tubular outer housing in the form of a carrier tube within which is received an elongated tubular structure in the form of a charge tube. Explosive perforating charges are mounted in the charge tube and are ballistically connected together via explosive detonating cord. In some instances, the charge tube may be located relative to the carrier tube to align the shaped perforating charges with reduced-thickness sections of the carrier tube. In many instances, such perforating guns are not able to effectively perforate a well with high pore pressures using a low shot density perforating gun. For example, such wells may need to be perforated in a completion scheme that does not necessarily require high flow area but does require a certain threshold of connectivity between the wellbore and the formation.

Due to a combination of factors, after the perforating charges are detonated, the wellbore is typically at a much higher energy state as compared to the internal volume of the perforating gun. Such factors may include, but are not limited to, high wellbore pressure, low shot density, a low amount of internal volume fill for the perforating gun, and/or high temperature explosives. The result of this scenario is a perforating event that causes a significant inrush of wellbore fluid into the perforating gun, resulting in a large transient reduction in wellbore pressure; if the wellbore pressure drops to a value below the reservoir pore fluid pressure, this condition is termed dynamic underbalance. An excessive amount of dynamic underbalance can possibly result in sanding or tunnel collapse. To reduce excessive drawdown within the wellbore, an additional energy source contained within the perforating gun is desirable.

DETAILED DESCRIPTION

Figure 1:
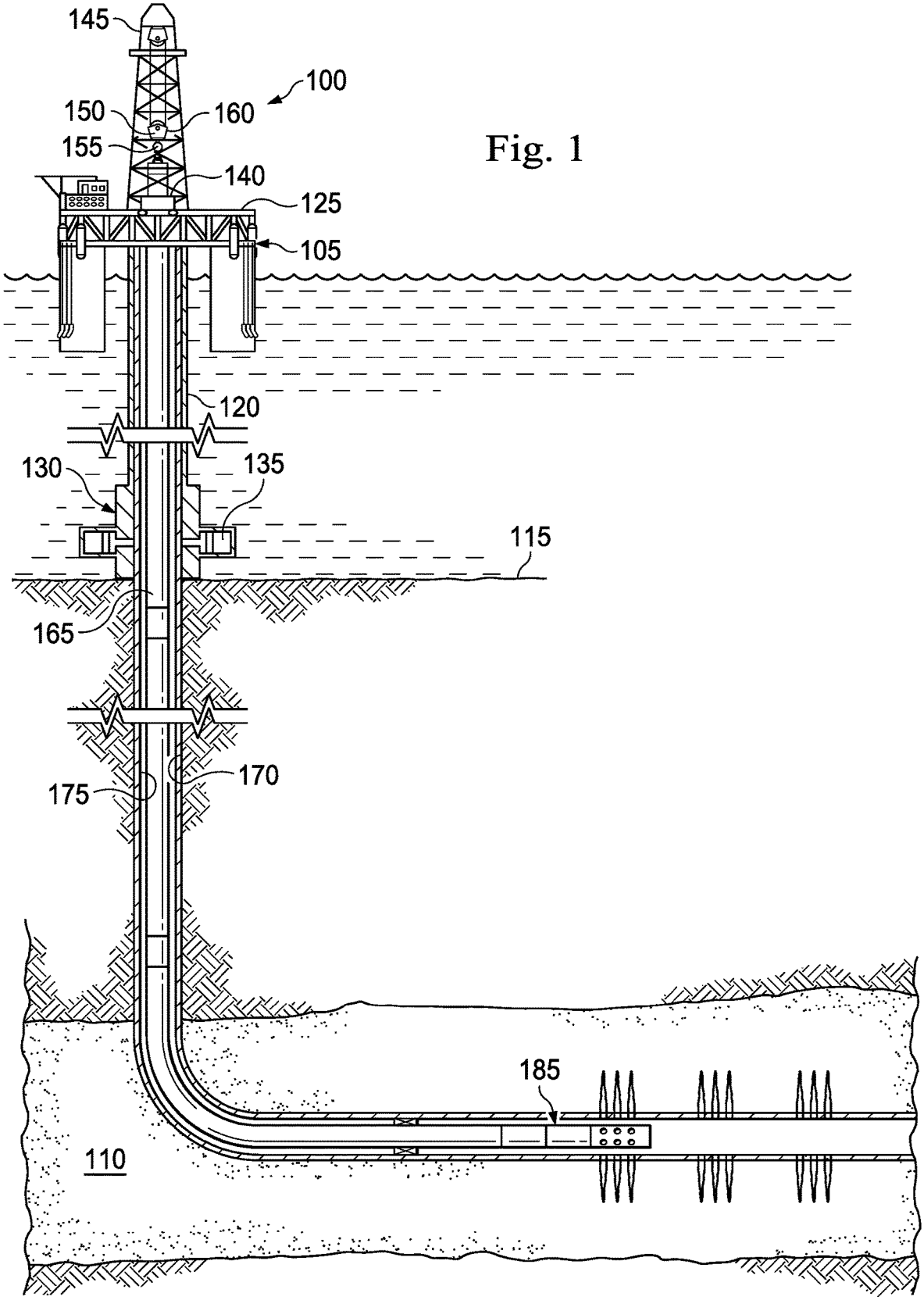
FIG. 1 is a schematic illustration of an offshore oil and gas platform operably coupled to a subsurface well perforating system, according to one or more embodiments of the present disclosure.

Referring to FIG. 1, in an embodiment, an offshore oil and gas rig is schematically illustrated and generally referred to by the reference numeral 100. In an embodiment, the offshore oil and gas rig 100 includes a semi-submersible platform 105 that is positioned over a submerged oil and gas formation 110 located below a sea floor 115. A subsea conduit 120 extends from a deck 125 of the platform 105 to a subsea wellhead installation 130. One or more pressure control devices 135, such as, for example, blowout preventers (BOPs), and/or other equipment associated with drilling or producing a wellbore may be provided at the subsea wellhead installation 130 or elsewhere in the system. The platform 105 may also include a hoisting apparatus 140, a derrick 145, a travel block 150, a hook 155, and a swivel 160, which components are together operable for raising and lowering a conveyance string 165. The conveyance string 165 may be, include, or be part of, for example, a casing, a drill string, a completion string, a work string, a pipe joint, coiled tubing, production tubing, other types of pipe or tubing strings, and/or other types of conveyance strings, such as wireline, slickline, and/or the like. The platform 105 may also include a kelly, a rotary table, a top drive unit, and/or other equipment associated with the rotation and/or translation of the conveyance string 165. A wellbore 170 extends from the subsea wellhead installation 130 and through the various earth strata, including the submerged oil and gas formation 110. At least a portion of the wellbore 170 includes a casing 175 secured therein by cement 180 (not visible in FIG. 1; shown in FIG. 2). The conveyance string 165 is, includes, or is operably coupled to a well perforating system 185 installed within the wellbore 170 and adapted to perforate the casing 175, the cement 180, and the wellbore 170 proximate the submerged oil and gas formation 110.

Figure 2:
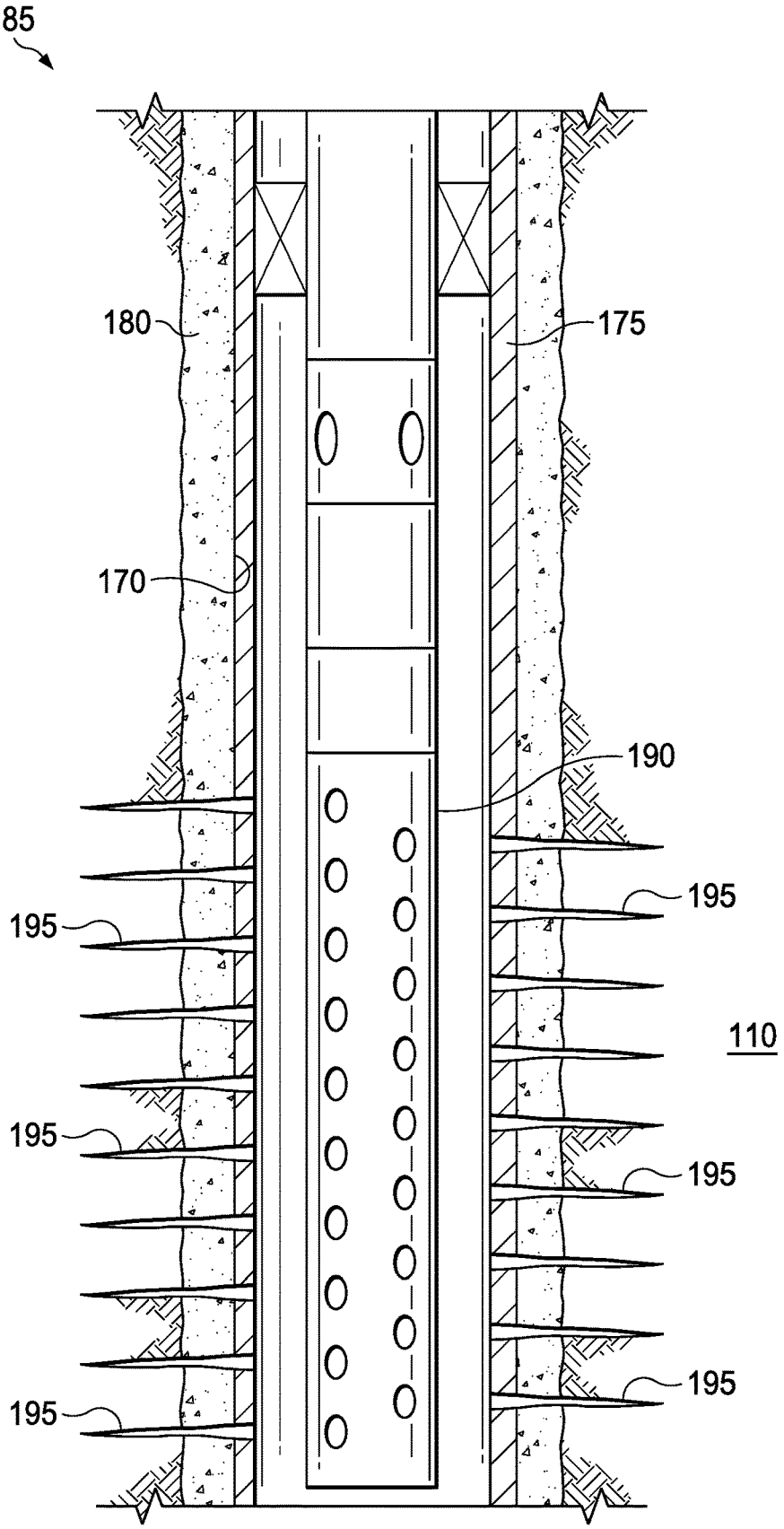
FIG. 2 is an enlarged elevational view of a perforating gun of the well perforating system of FIG. 1, according to one or more embodiments of the present disclosure.

Referring to FIG. 2, in several embodiments, the well perforating system 185 of FIG. 1 includes a perforating gun 190 that extends within the wellbore 170, which wellbore is lined with the casing 175 and the cement 180. The perforating gun 190 is operable to form perforations 195 through the casing 175 and the cement 180 so that fluid communication is established between the casing 175 and the submerged oil and gas formation 110 surrounding the wellbore 170. More particularly, the perforating gun 190 includes perforating charges that are detonatable to form the perforations 195 through the casing 175 and the cement 180. In some systems, after the perforating charges are detonated, there can be a reduction in wellbore pressure due to wellbore fluids flowing into the (detonated) perforating gun. The perforating gun 190 of the present disclosure addresses this issue by preventing, or at least reducing, the reduction of pressure in the wellbore 170 following detonation of the perforating charges, as described in further detail below. In various embodiments, one or more components of the perforating gun 190 described herein can be integrated with one or more other components of the perforating gun 190. Accordingly, other perforating guns that do not include each and every component of the perforating gun 190 described herein may nevertheless fall within the scope of the present disclosure.

Figure 3A:
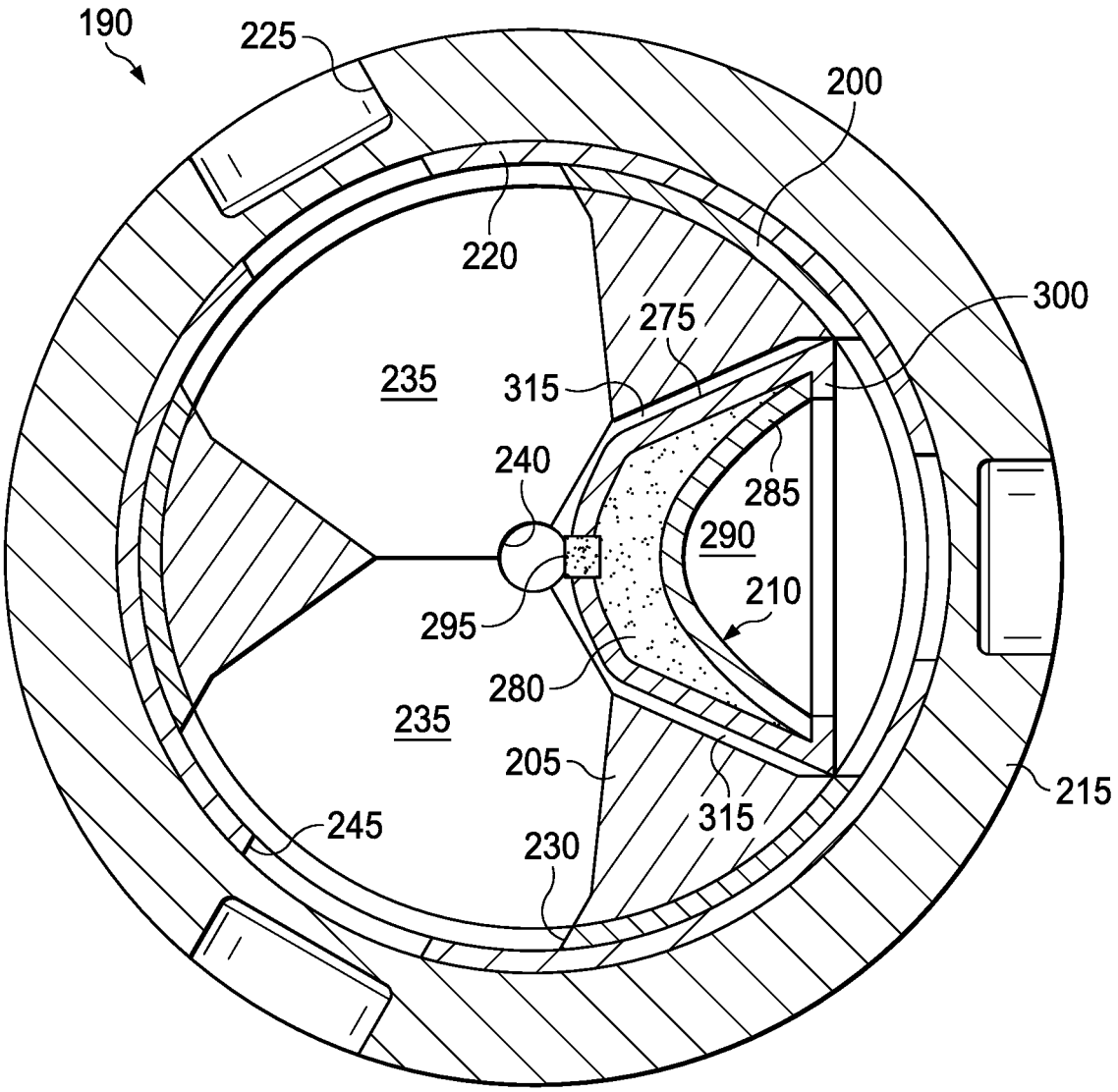
FIG. 3A is a cross-sectional view of the perforating gun of FIG. 2, according to one or more embodiments of the present disclosure.

Referring to FIG. 3A, in several embodiments, the perforating gun 190 includes a charge tube 200, a fill body 205 extending within the charge tube 200, and perforating charges 210 extending within, and supported by, the fill body 205. The charge tube 200 extends within a carrier tube 215. In several embodiments, a debris guard 220 extends between the charge tube 200 and the carrier tube 215. Alternatively, the debris guard 220 may be omitted. In several embodiments, the charge tube 200, the debris guard 220, and/or the carrier tube 215 are coaxial. The carrier tube 215 includes gun ports such as, for example, scallops 225 (i.e., thin-walled recessed areas) that are radially and axially aligned with the respective perforating charges 210 (e.g., shaped charges). The charge tube 200 includes gun ports such as, for example, apertures 230 that are radially and axially aligned with the respective perforating charges 210. In several embodiments, the apertures 230 in the charge tube 200 are sized and shaped to allow servicing and/or installation of the perforating charges 210 therethrough when the fill body 205 extends within the charge tube 200.

The fill body 205 includes sockets 235 in which respective ones of the perforating charges 210 are disposed. An axial passage 240 is formed through the fill body 205 to accommodate a detonating mechanism (not shown) for the perforating charges 210. The debris guard 220 includes gun ports such as, for example, apertures 245 that are radially and axially aligned with the respective perforating charges 210. In several embodiments, the apertures 245 of the debris guard 220 are relatively smaller in shape than the corresponding apertures 230 of the charge tube 200. As a result, the debris guard 220 prevents, or at least obstructs, spall and other debris from exiting the perforating gun 190 and collecting in the wellbore 170 (shown in FIGS. 1 and 2) during and/or after detonation of the perforating charges 210.

Figure 3B:
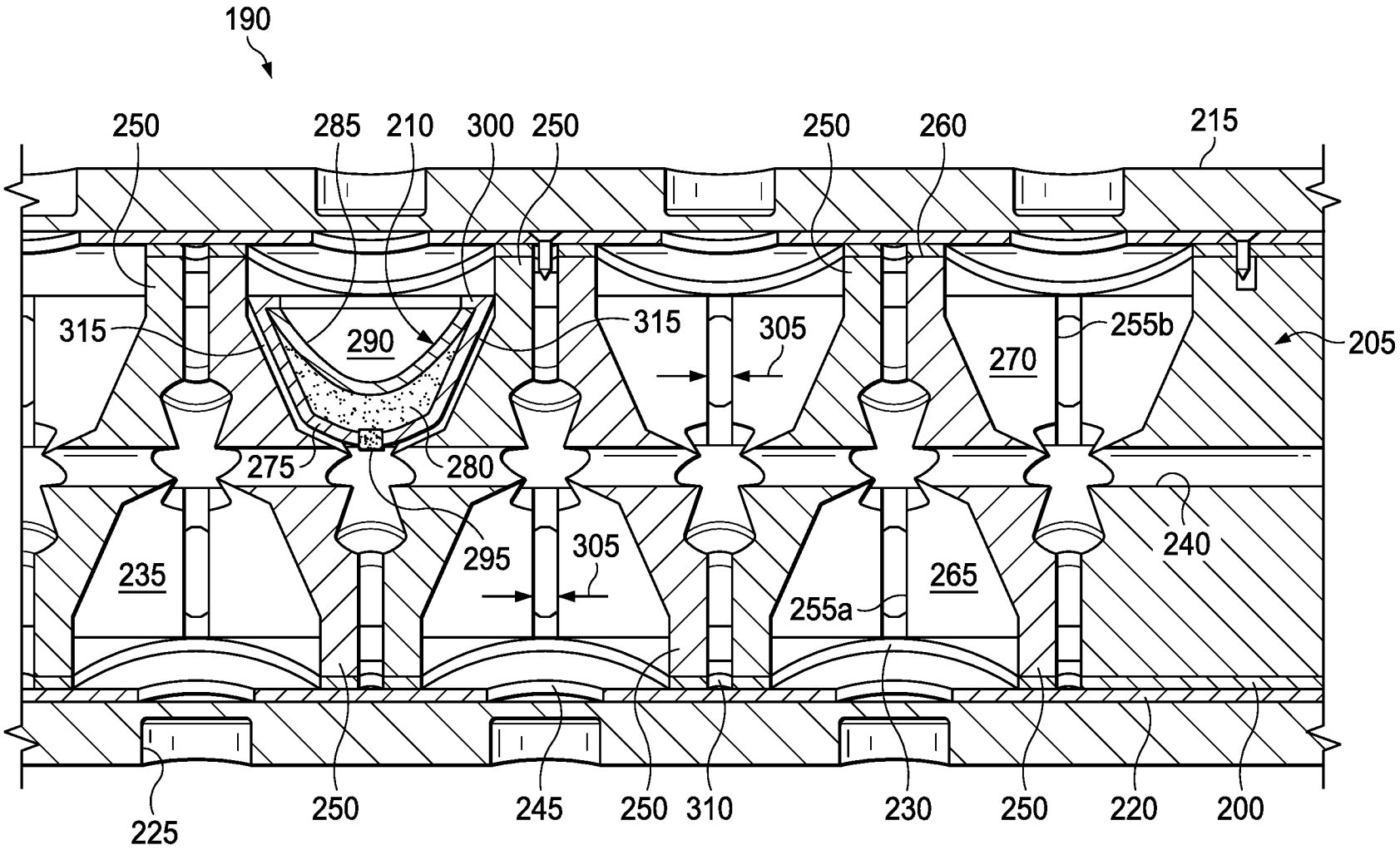
FIG. 3B is a cross-sectional view of the perforating gun of FIG. 3A, said perforating gun including a charge tube and a fill body positioned inside the charge tube, said fill body being divided into divider segments, according to one or more embodiments of the present disclosure.

Referring to FIG. 3B, in several embodiments, the fill body 205 is divided into divider segments 250. The divider segments 250 are arranged within the charge tube 200 in a longitudinal stack. More particularly, during assembly of the perforating gun 190, the charge tube 200 acts as a support structure in which the divider segments 250 are stacked and in which the perforating charges 210 are operably coupled to the detonating mechanism (not shown) extending within the axial passage 240. The divider segments 250 each include opposing end portions 255*a* and 255*b* and an exterior surface 260 extending between the opposing end portions 255*a* and 255*b*.

Concavities 265 are formed in the end portion 255*a* and through the exterior surface 260. For example, three (3) of the concavities 265 may be formed in the end portion 255*a* and circumferentially-spaced apart by 120-degrees. In other instances, one (1), two (2), four (4), or more of the concavities 265 may be formed in the end portion 255*a*. The concavities 265 are sized and shaped (e.g., in a semi-cylindrical, semi-conical, or similar shape) to accommodate respective first portions of the perforating charges 210. Similarly, concavities 270 are formed in the end portion 255*b* and through the exterior surface 260. For example, three (3) of the concavities 270 may be formed in the end portion 255*b* and circumferentially-spaced apart by 120-degrees. In other instances, one (1), two (2), four (4), or more of the concavities 270 may be formed in the end portion 255*b*. The concavities 270 are sized and shaped (e.g., in a semi-cylindrical, semi-conical, or similar shape) to accommodate respective second portions of the perforating charges 210. In several embodiments, as in FIG. 3B, the concavities 265 in the end portion 255*a* are circumferentially-offset from (e.g., by 60-degrees), and interposed between, the concavities 270 in the end portion 255*b*.

The perforating charges 210 are supported between adjacent ones of the divider segments 250. More particularly, the divider segments 250 are arranged so that the respective concavities 265 and 270 in adjacent ones of the divider segments 250 are aligned to form the sockets 235 in the fill body 205. As shown in FIG. 3B, the sockets 235, and thus the perforating charges 210, may be longitudinally spaced along the charge tube 200. For example, the perforating charges 210 may extend helically along the charge tube 200.

In several embodiments, the perforating charges 210 each include a charge case 275, an energetic compound 280, a liner 285 defining a bell-shaped void 290 pointing toward a jetting-end of the perforating charge 210, and an energetic booster 295. The energetic boosters 295 are each operably coupled to the detonating mechanism (not shown) extending within the axial passage 240 to facilitate detonation of the perforating charges 210. An outer flange 300 may be formed in the charge case 275 at the jetting-end of each of the perforating charges 210. In several embodiments, adjacent ones of the divider segments 250 support the perforating charges 210 at the respective outer flanges 300 thereof.

In several embodiments, adjacent ones of the divider segments 250 are spaced apart by gaps 305. For example, the gaps 305 may ensure that the divider segments 250 do not have direct contact with each other prior to detonation of the perforating charges 210. For another example, the gaps 305 may allow space for controlled expansion of each perforating charge 210's outer charge case 275. For yet another example, the gaps 305 may allow space for collection and recombination of debris and spall material during and/or after detonation of the perforating charges 210. Although the gaps 305 are shown in FIG. 3B extending in a perpendicular orientation relative to a longitudinal axis of the perforating gun 190, the gaps 305 may instead extend in an angular (e.g., acute and/or obtuse) orientation relative to the longitudinal axis of the perforating gun 190. The charge tube 200 may also include openings 310 opposite the apertures 230, which openings are aligned with the gaps 305 to provide additional volume for reconsolidation of spall material and other material during and/or after detonation of the perforating charges 210. Additionally, at least respective portions of the charge cases 275 may be spaced apart from the divider segments 250 by gaps 315. The gaps 315 allow space for controlled expansion of the charge cases 275 and collection and recombination of debris and spall material during and/or after detonation of the perforating charges 210.

Figure 3C:
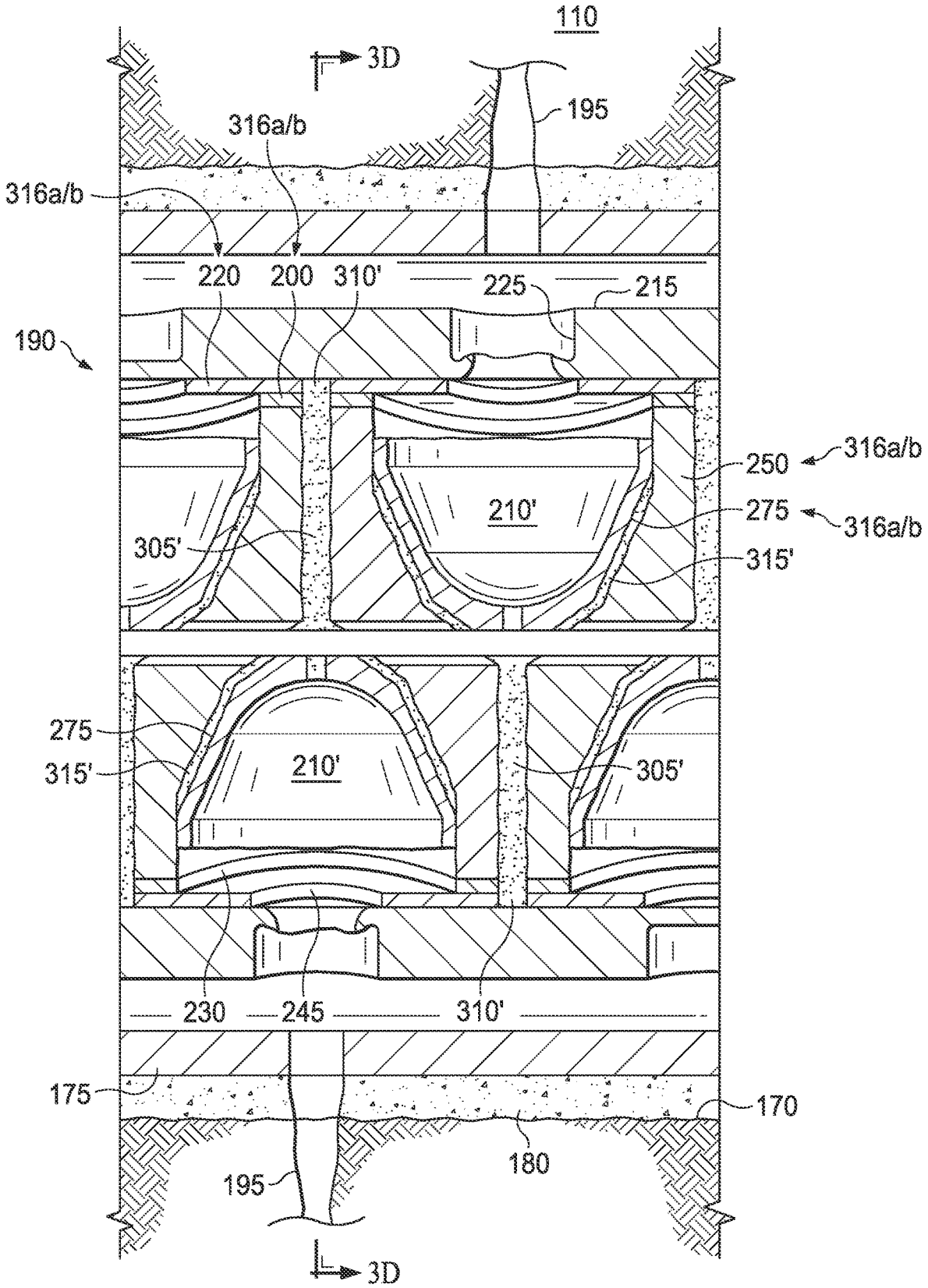
FIG. 3C is a cross-sectional view similar to that shown in FIG. 3B, except that the perforating gun is shown in a detonated state, according to one or more embodiments of the present disclosure.
Figure 3D:
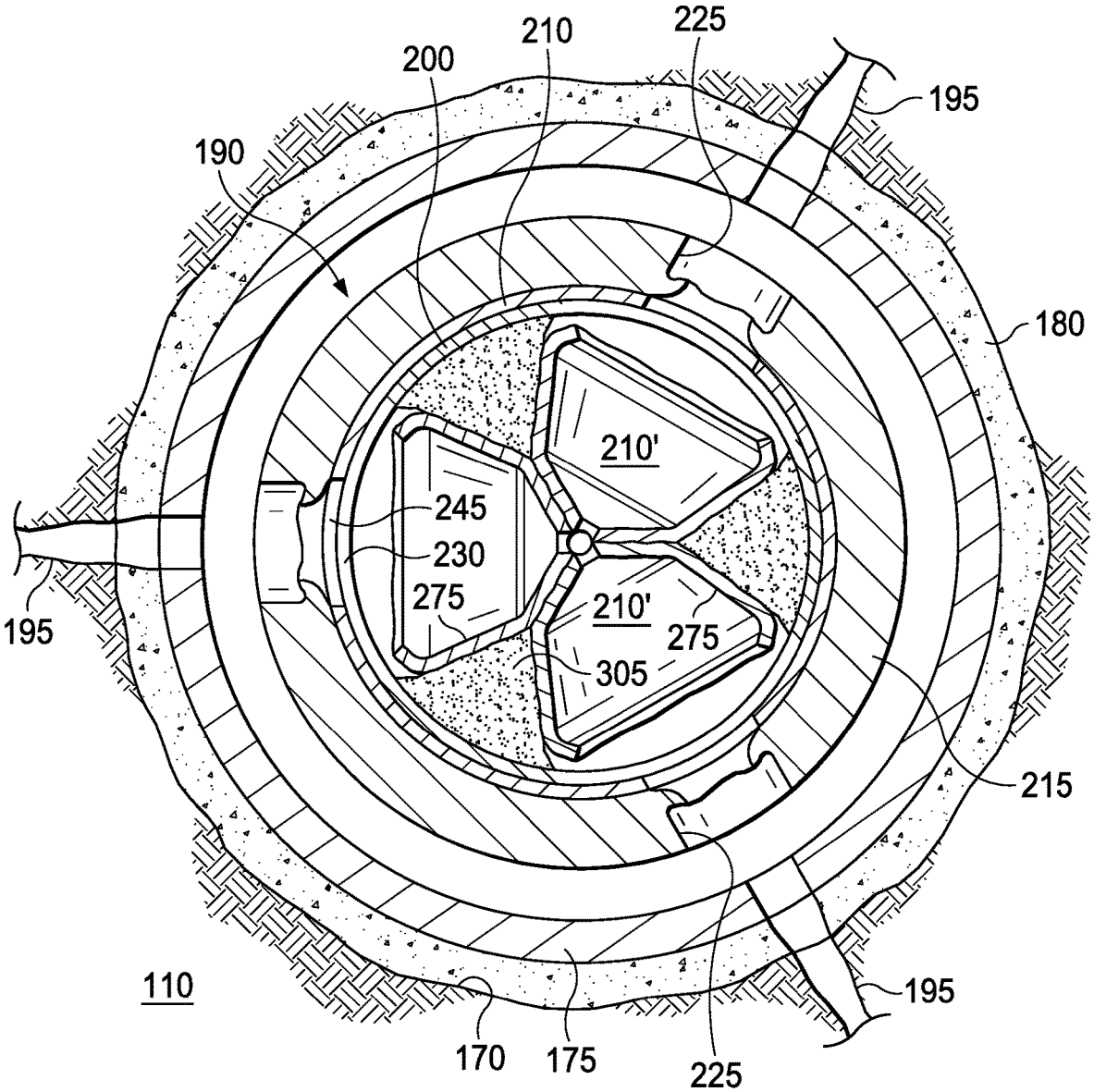
FIG. 3D is a cross-sectional view similar to that shown in FIG. 3A, except that the perforating gun is shown in a detonated state, according to one or more embodiments of the present disclosure.

Referring to FIGS. 3C and 3D, in several embodiments, a number of the perforating charges 210 may be detonated to form the perforations 195 through the casing 175 and the cement 180 so that fluid communication is established between the casing 175 and the submerged oil and gas formation 110 surrounding the wellbore 170. After the perforating charges 210 have been detonated, as indicated by reference numerals 210', debris and spall collect and recombine in the gaps 305, the openings 310, and/or the gaps 315, as indicated by reference numerals 305', 310', and 315'. Specifically, detonation of the perforating charges 210 causes a shock wave to cross between adjacent ones of the divider segments 250. Propagation of this wave across the free surfaces of the divider segments 250 creates a tensile wave on the boundaries of said divider segments 250. Simultaneously, a compression wave is reflected backwards. Both the forward transmitted wave and the reflected wave are lower in magnitude than the initial shock wave. The tensile wave acting on the free surfaces of the divider segments 250 may pull material off as it moves across the gap 305, thereby producing spall. In addition, or instead, the divider segments 250 may be broken down into debris and spall in other ways upon detonation of the perforating charges 210. The charge tube 200 and the debris guard 220 retain debris and spall within the perforating gun 190.

Due to a combination of factors, including, but not limited to, high wellbore pressures, low shot density, a low amount of internal volume fill, and/or high temperature energetics, the wellbore 170 may be at a much higher energy state than the perforating gun 190's internal volume after detonation of the perforating charges 210. In view of such factors, the execution of a perforating event can create a high dynamic underbalance resulting in possible sanding or tunnel collapse in or near the wellbore 170. Accordingly, to combat such excessive drawdown within the wellbore 170, an additional energy source contained within the perforating gun 190 is desirable. The well perforating system 185 of the present disclosure aims to provide such an additional energy source. Specifically, in various embodiments, adjacent components of the perforating gun 190 together form a two-component or binary energetic including first and second components 316*a* and 316*b*, respectively (shown in FIGS. 3C, 3E, 4A, 4B, 5A, and 5B), neither of which is energetic by itself, but which have to be mixed together in order to become energetic. Such a binary energetic provides a way to control internal energy (e.g., pressure transients) of the perforating gun 190, especially in instances in which the perforating gun 190 itself (i.e., the perforating charges 210) has low internal energy due to either low shot densities (low energetic density per free volume) or low energetic output (high temperature energetics). Moreover, the added binary materials are essentially inert (non-energetic) binary materials that are able to add internal energy to the perforating gun without changing the shipping classification of the loaded perforating gun. The added binary materials enable the well perforating system 185 to effectively perforate a well with high pore pressures even if the perforating gun 190 has low shot density or low energetic output. Accordingly, the well perforating system 185 may be valuable in a completion scheme that does not necessarily require a high flow area but does require a certain threshold level of connectivity between the wellbore 170 and the submerged oil and gas formation 110 (e.g., via deep penetrating or "DP" charges).

In several embodiments, the debris guard 220, the charge tube 200, at least one of the charge cases 275, and/or at least one of the divider segments 250 may be, include, or be part of the first component 316*a* of the binary energetic. For example, the first component 316*a* of the binary energetic may be provided via a coating on the debris guard 220, the charge tube 200, the at least one of the charge cases 275, and/or the at least one of the divider segments 250. For another example, the first component 316*a* of the binary energetic may be or include a thin wafer provided adjacent the debris guard 220, the charge tube 200, the at least one of the charge cases 275, and/or the at least one of the divider segments 250.

In several embodiments, the debris guard 220, the charge tube 200, at least one of the charge cases 275, and/or at least one of the divider segments 250 may be, include, or be part of the second component 316*b* of the binary energetic. For example, the second component 316*b* of the binary energetic may be provided via a coating on the debris guard 220, the charge tube 200, the at least one of the charge cases 275, and/or the at least one of the divider segments 250. For another example, the second component 316*b* of the binary energetic may be or include a thin wafer provided adjacent the debris guard 220, the charge tube 200, the at least one of the charge cases 275, and/or the at least one of the divider segments 250.

In several embodiments, the first and second components 316*a* and 316*b* of the binary energetic are configured to react in an Oxide-Reducer reaction. For example, one of the first and second components 316*a* and 316*b* of the binary energetic may be Iron II Oxide ($Fe_2O_3$) and the other of the first and second components 316*a* and 316*b* of the binary energetic may be Aluminum (Al) or Magnesium (Mg). For another example, one of the first and second components 316*a* and 316*b* of the binary energetic may be Iron II, III Oxide ($Fe_3O_4$) and the other of the first and second components 316*a* and 316*b* of the binary energetic may be Aluminum (Al) or Magnesium (Mg). For yet another example, one of the first and second components 316*a* and 316*b* of the binary energetic may be Copper II Oxide (CuO) and the other of the first and second components 316*a* and 316*b* of the binary energetic may be Aluminum (Al) or Magnesium (Mg). For yet another example, one of the first and second components 316*a* and 316*b* of the binary energetic may be Manganese Dioxide ($MnO_2$) and the other of the first and second components 316*a* and 316*b* of the binary energetic may be Aluminum (Al) or Magnesium (Mg). For yet another example, one of the first and second components 316*a* and 316*b* of the binary energetic may be Manganese III Oxide ($MnO_3$) and the other of the first and second components 316*a* and 316*b* of the binary energetic may be Aluminum (Al) or Magnesium (Mg). For yet another example, one of the first and second components 316*a* and 316*b* of the binary energetic may be Molybdenum VI Oxide ($MoO_3$) and the other of the first and second components 316*a* and 316*b* of the binary energetic may be Aluminum (Al) or Magnesium (Mg). For yet another example, one of the first and second components 316*a* and 316*b* of the binary energetic may be Aluminum Tantalum and the other of the first and second components 316*a* and 316*b* of the binary energetic may be Aluminum (Al) or Magnesium (Mg). For yet another example, one of the first and second components 316*a* and 316*b* of the binary energetic may be Bismuth III Oxide ($Bi_2O_3$) and the other of the first and second components 316*a* and 316*b* of the binary energetic may be Aluminum (Al) or Magnesium (Mg).

In operation, after the perforating charges 210 explode to perforate the wellbore 170 proximate the submerged oil and gas formation 110, shock-induced mixing and activation of the first and second components 316*a* and 316*b* of the binary energetic prevents, or at least reduces, a reduction in pressure in the wellbore 170 due to fluids in the wellbore 170 flowing into the perforating gun 190. More particularly, after the well perforating system 185 is detonated, energetically driven shock waves from the detonation of the perforating charges 210 create ejecta (e.g., via spallation) from internal components of the perforating gun 190, said internal components including at least the first and second components 316*a* and 316*b* of the binary energetic. The ejecta of the first and second components 316*a* and 316*b* of the binary energetic are mixed by the shock waves. Moreover, a reaction between the mixed first and second components 316*a* and 316*b* of the binary energetic is initiated by the shock waves, which reaction releases enthalpy via interaction of the newly-formed and highly-energized binary mixture. More particularly, the reaction between the mixed first and second components 316*a* and 316*b* of the binary energetic releases enthalpy in the form of heat, vaporization, or a combination thereof. For example, Copper II Oxide (CuO) evolves quickly in an intermetallic reaction, and, when a subsequent Cu—Cu bond is broken, it is released as a monoatomic (Cu) gas. As a result, the binary mixture lowers the mismatch in energy states between the perforating gun 190's internal volume and the wellbore 170 by providing additional internal energy to the perforating gun 190. In addition, reacted products and unused reactants may take up a substantial remnant volume within the perforating gun 190, thereby acting as gun filler.

In several embodiments, at least the gaps 305, the openings 310, and/or the gaps 315 serve as a reaction vessel in which the ejecta of the first and second components 316*a* and 316*b* of the binary energetic are collected and reconsolidated, as indicated by the reference numerals 305', 310', and 315' in FIGS. 3C and 3D. Specifically, when the gaps 305, the openings 310, and/or the gaps 315 are filled with the ejecta of the first and second components 316*a* and 316*b* of the binary energetic, the first and second components 316*a* and 316*b* of the binary energetic are able to react with each other in a highly confined manner such that the void volume acts as a small reaction vessel confining (or nearly confining) the reaction of the first and second components 316*a* and 316*b*.

Figure 3E:
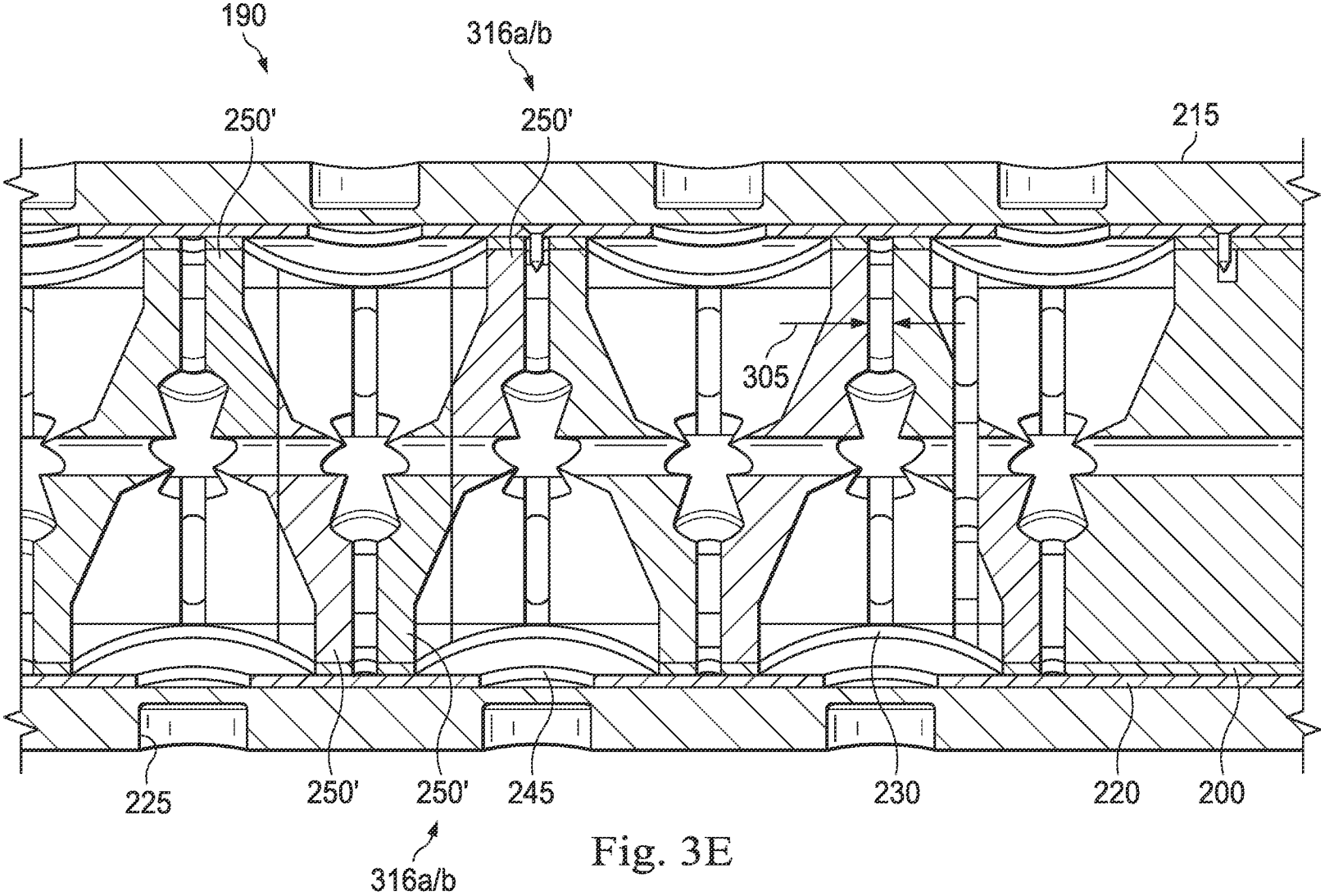
FIG. 3E is a cross-sectional view similar to that shown in FIG. 3B, except that at least some of the divider segments of the fill body are subdivided into smaller divider segments, according to one or more embodiments of the present disclosure.

Referring to FIG. 3E, with continuing reference to FIG. 3B, in several embodiments, one or more of the divider segments 250 may be subdivided into divider segments 250'. At least one of the divider segments 250' may be, include, or be part of the first component 316*a* of the binary energetic. For example, the first component 316*a* of the binary energetic may be provided via a coating on the at least one of the divider segments 250'. For another example, the first component 316*a* of the binary energetic may be or include a thin wafer provided adjacent the at least one of the divider segments 250'. In addition, or instead, at least one of the divider segments 250' may be, include, or be part of the second component 316*b* of the binary energetic. For example, the second component 316*b* of the binary energetic may be provided via a coating on the at least one of the divider segments 250'. For another example, the second component 316*b* of the binary energetic may be or include a thin wafer provided adjacent the at least one of the divider segments 250'.

Upon detonation of the perforating charges 210, the divider segments 250' may be broken down into debris and spall in a substantially similar manner to the manner in which the divider segments 250 are broken down into debris and spall upon detonation of the perforating charges 210. However, due to their overall thickness and/or geometry, the divider segments 250' may yield a more complete mass of reactants for the shock-induced mixing and activation of the first and second components 316*a* and 316*b* of the binary energetic as compared to the divider segments 250. An overall axial thickness and/or geometry of the divider segments 250' may be varied, depending on the specific needs of the wellbore 170. By varying the overall thickness and/or geometry of the divider segments 250', the volume of the gaps 305 and/or the gaps 315 may be controlled, thereby allowing an operator to easily select an overall desired free volume of the perforating gun 190. As a result, the free volume of perforating gun 190 can be varied with fine resolution along a sliding scale from a minimum free volume to a maximum free volume. To promote the creation of debris and spall, the divider segments 250' may be formed of a longitudinal stack of disks or plates, a coaxial arrangement of sleeves, another sutable arrangement, or any combination thereof.

Figure 4A:
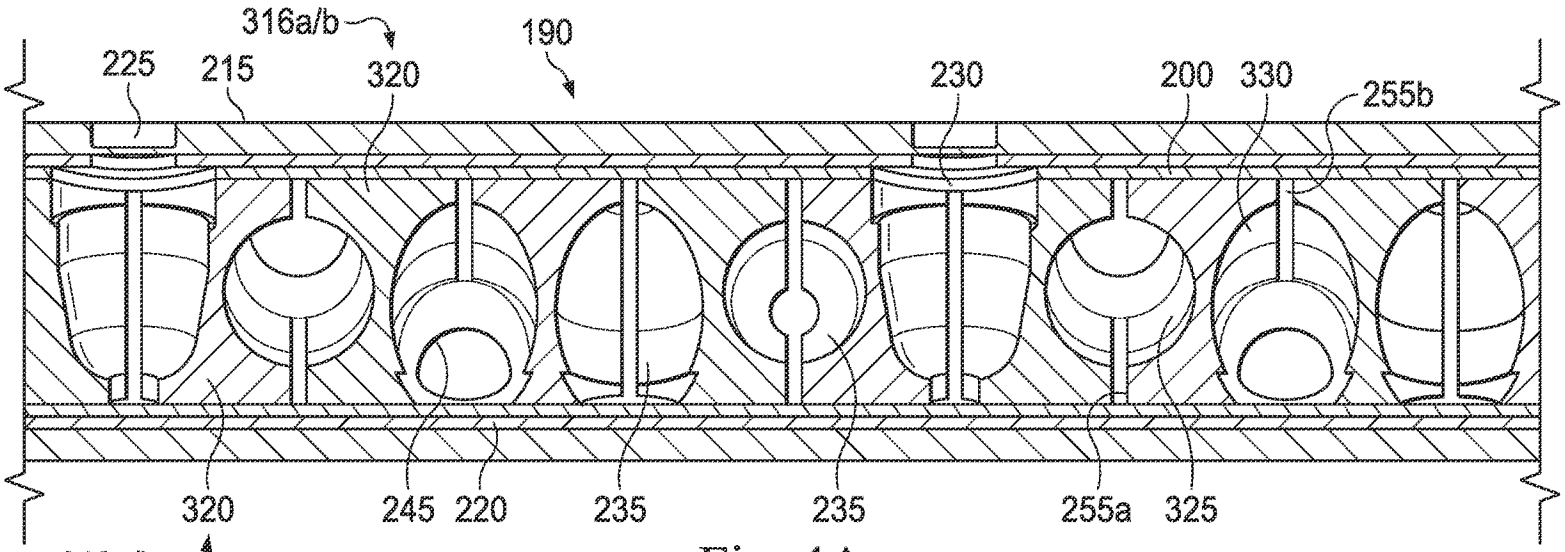
FIG. 4A is a cross-sectional view of the perforating gun of FIG. 2, said perforating gun including a charge tube and a fill body positioned inside the charge tube, said fill body being divided into divider segments, according to one or more embodiments of the present disclosure.

Referring to FIG. 4A, in several embodiments, the divider segments 250 may be replaced with divider segments 320. At least one of the divider segments 320 may be, include, or be part of the first component 316*a* of the binary energetic. For example, the first component 316*a* of the binary energetic may be provided via a coating on the at least one of the divider segments 320. For another example, the first component 316*a* of the binary energetic may be or include a thin wafer provided adjacent the at least one of the divider segments 320. In addition, or instead, at least one of the divider segments 320 may be, include, or be part of the second component 316*b* of the binary energetic. For example, the second component 316*b* of the binary energetic may be provided via a coating on the at least one of the divider segments 320. For another example, the second component 316*b* of the binary energetic may be or include a thin wafer provided adjacent the at least one of the divider segments 320.

Upon detonation of the perforating charges 210, the divider segments 320 may be broken down into debris and spall in a manner substantially similar to the manner in which the divider segments 250 are broken down into debris and spall upon detonation of the perforating charges 210. Additionally, the divider segments 320 are similar to the divider segments 250, except that: the three (3) of the concavities 265 are replaced with one (1) concavity 325 at the end portion 255*a*; the three (3) of the concavities 270 are replaced with one (1) concavity 330 at the end portion 255*b*; adjacent ones of the concavities 325 and 330 together form the sockets 235; the apertures 230 of the charge tube 200, the apertures 245 of the debris guard 220, and the scallops 225 of the carrier tube 215 are repositioned to be radially and axially aligned with the perforating charges 210 supported within the sockets 235 formed by the cavities 325 and 330; and the axial passage 240 is replaced with an external groove (not shown) formed around the fill body 325 (e.g., helically) to accommodate the detonating mechanism (not shown). The sockets 235 (and thus the perforating charges 210) may be arranged helically along the charge tube 200. For example, the divider segments 320 may be rotated 60-degrees per segment along the charge tube 200.

Figure 4B:
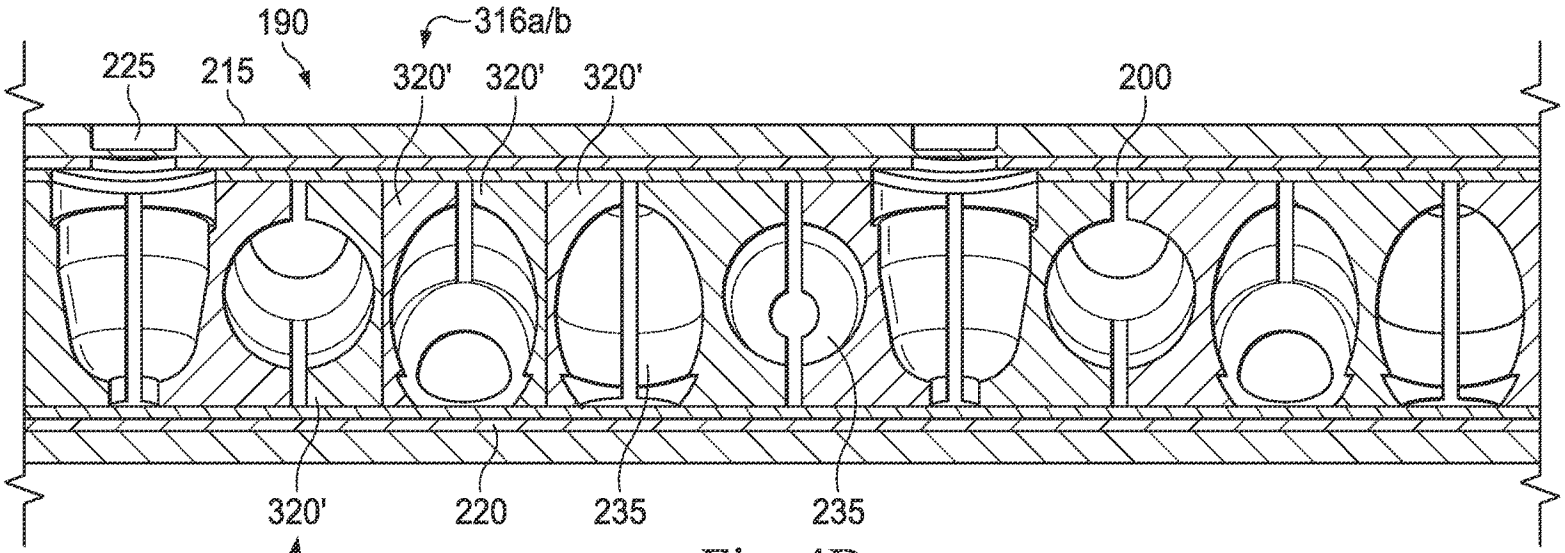
FIG. 4B is a cross-sectional view similar to that shown in FIG. 4A, except that at least some of the divider segments of the fill body are subdivided into smaller divider segments, according to one or more embodiments of the present disclosure.

Referring to FIG. 4B, with continuing reference to FIG. 4A, in several embodiments, one or more of the divider segments 320 may be subdivided into divider segments 320'. At least one of the divider segments 320' may be, include, or be part of the first component 316*a* of the binary energetic. For example, the first component 316*a* of the binary energetic may be provided via a coating on the at least one of the divider segments 320'. For another example, the first component 316*a* of the binary energetic may be or include a thin wafer provided adjacent the at least one of the divider segments 320'. In addition, or instead, at least one of the divider segments 320' may be, include, or be part of the second component 316*b* of the binary energetic. For example, the second component 316*b* of the binary energetic may be provided via a coating on the at least one of the divider segments 320'. For another example, the second component 316*b* of the binary energetic may be or include a thin wafer provided adjacent the at least one of the divider segments 320'.

Upon detonation of the perforating charges 210, the divider segments 320' may be broken down into debris and spall in a substantially similar manner to the manner in which the divider segments 320 are broken down into debris and spall upon detonation of the perforating charges 210. However, due to their overall thickness and/or geometry, the divider segments 320' may yield a more complete mass of reactants for the shock-induced mixing and activation of the first and second components 316*a* and 316*b* of the binary energetic (as compared to the divider segments 320). An overall axial thickness and/or geometry of the divider segments 320' may be varied, depending on the specific needs of the wellbore. By varying the overall thickness and/or geometry of the divider segments 320', the volume of the gaps 305 and/or the gaps 315 may be controlled, thereby allowing an operator to easily select an overall desired free volume of the perforating gun 190. As a result, the free volume of perforating gun 190 can be varied with fine resolution from a minimum free volume to a maximum free volume. To promote creation of spall, the divider segments 320' may be formed of a longitudinal stack of disks or plates, a coaxial arrangement of sleeves, another suitable arrangement, or any combination thereof.

Figure 5A:
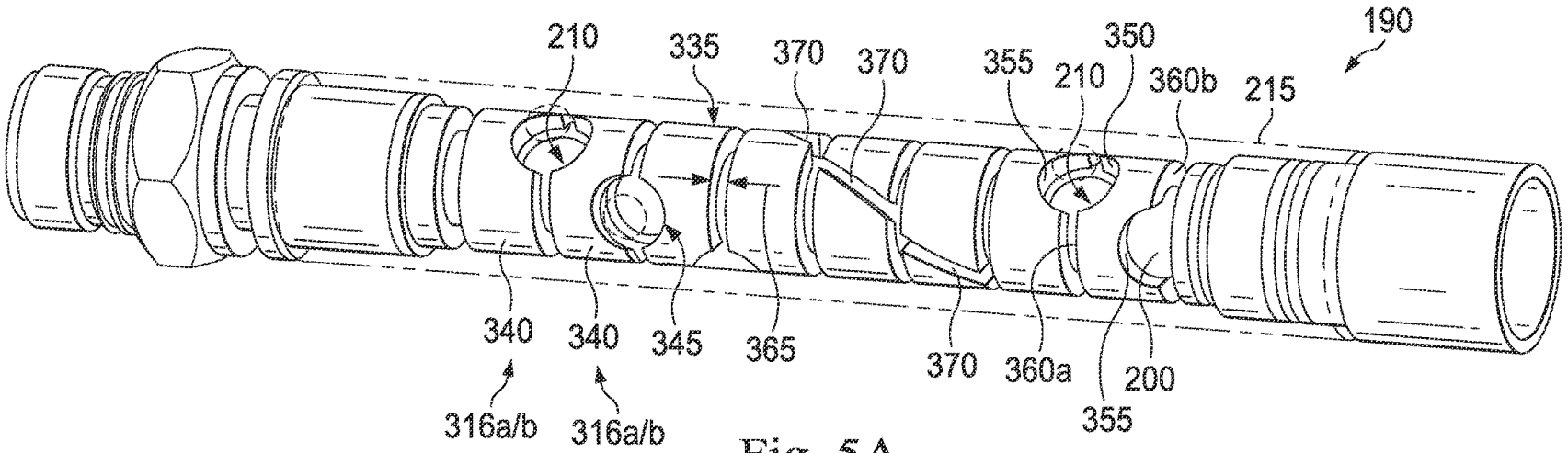
FIG. 5A is a perspective view of the perforating gun of FIG. 2, said perforating gun including a charge tube, a carrier tube, and a fill body positioned between the charge tube and the carrier tube, said fill body being divided into divider segments, according to one or more embodiments of the present disclosure.

Referring to FIG. 5A, in several embodiments, a fill body 335 is positioned (e.g., annularly) between the carrier tube 215 and the charge tube 200, said fill body 335 being divided into divider segments 340. At least one of the divider segments 340 may be, include, or be part of the first component 316*a* of the binary energetic. For example, the first component 316*a* of the binary energetic may be provided via a coating on the at least one of the divider segments 340. For another example, the first component 316*a* of the binary energetic may be or include a thin wafer provided adjacent the at least one of the divider segments 340. In addition, or instead, at least one of the divider segments 340 may be, include, or be part of the second component 316*b* of the binary energetic. For example, the second component 316*b* of the binary energetic may be provided via a coating on the at least one of the divider segments 340. For another example, the second component 316*b* of the binary energetic may be or include a thin wafer provided adjacent the at least one of the divider segments 340.

Upon detonation of the perforating charges 210, the divider segments 340 may be broken down into debris and spall in a manner substantially similar to the manner in which the divider segments 250 are broken down into debris and spall upon detonation of the perforating charges 210. Additionally, adjacent ones of the divider segments 340 may be shaped to cooperate with one another so as to form recesses 345 (e.g., cut-outs). In this regard, in several embodiments, the divider segments 340 each overlap adjacent ones of the perforating charges 210. For example, each of the divider segments 340 may be disposed axially along the charge tube 200 between successive ones of the perforating charges 210. Accordingly, each of the divider segments 340 may include partial recesses 350 and 355 formed at respective opposing end portions 360*a* and 360*b* thereof. As a result, the partial recesses 350 and 355 of adjacent ones of the divider segments 340 together make up one of the recesses 345 over a corresponding one of the perforating charges 210.

While adjacent ones of the divider segments 340 may abut one another, in several embodiments, gaps 365 are instead formed between adjacent ones of the divider segments 340. The gaps 365 are variable in size by adjusting respective lengths of the divider segments 340. In this regard, the divider segments 340 may be produced with differing lengths to vary the available free gun volume outside of the charge tube 200, resulting in a highly adjustable free gun volume. Upon detonation of the perforating charges 210, the gaps 365 may collect and reconsolidate debris and spall in a manner similar to the manner in which the gaps 305 collect and reconsolidate debris and spall, as discussed above. In several embodiments, the gaps 365 serve as a reaction vessel in which the ejecta of the first and second components 316*a* and 316*b* of the binary energetic are collected and reconsolidated. Specifically, when the gaps 365 are filled with the ejecta of the first and second components 316*a* and 316*b* of the binary energetic, the first and second components 316*a* and 316*b* of the binary energetic are able to react with each other in a highly confined manner such that the void volume acts as a small reaction vessel confining (or nearly confining) the reaction of the first and second components 316*a* and 316*b*.

In addition to the recesses 345, one or more of the divider segments 340 may include a groove 370 formed therein to allow the detonation cord to extend across the fill body 335. In several embodiments, the groove 370 may be helical along the length of the fill body 335 from one end of the fill body 335 to the other, such that when a plurality of the divider segments 340 are positioned adjacent one another, a helical path for a detonation cord (not shown) is formed along a portion of the length of the perforating gun 190.

Figure 5B:
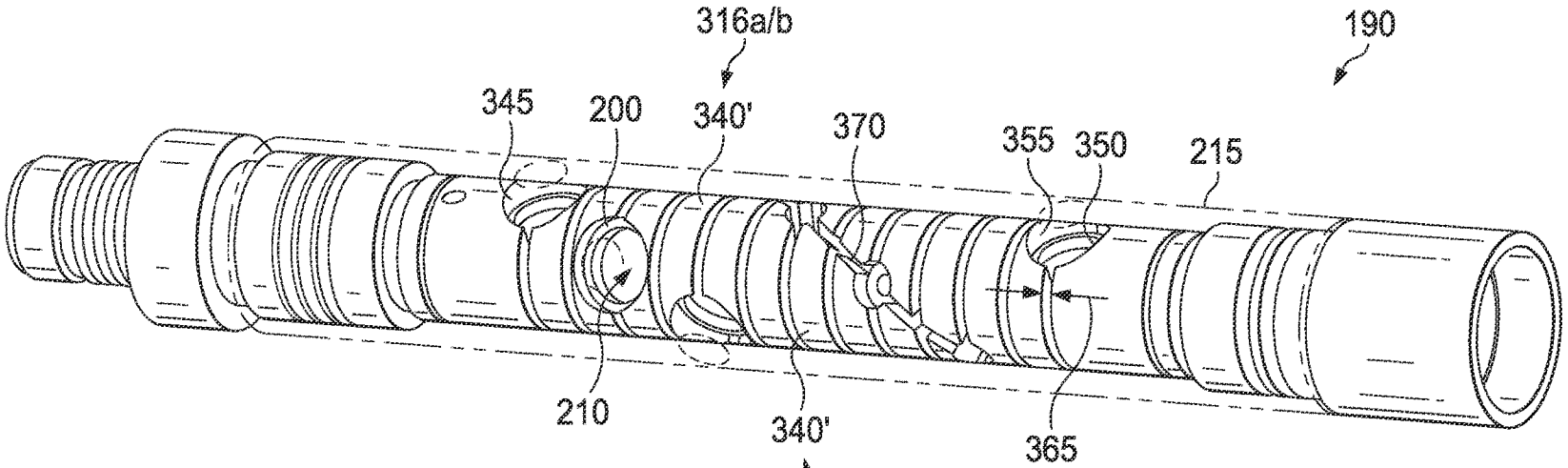
FIG. 5B is a perspective view similar to that shown in FIG. 4A, except that at least some of the divider segments of the fill body are subdivided into smaller divider segments, according to one or more embodiments of the present disclosure.

Referring to FIG. 5B, with continuing reference to FIG. 5A, in several embodiments, one or more of the divider segments 340 may be subdivided into divider segments 340'. At least one of the divider segments 340' may be, include, or be part of the first component 316*a* of the binary energetic. For example, the first component 316*a* of the binary energetic may be provided via a coating on the at least one of the divider segments 340'. For another example, the first component 316*a* of the binary energetic may be or include a thin wafer provided adjacent the at least one of the divider segments 340'. In addition, or instead, at least one of the divider segments 340' may be, include, or be part of the second component 316*b* of the binary energetic. For example, the second component 316*b* of the binary energetic may be provided via a coating on the at least one of the divider segments 340'. For another example, the second component 316*b* of the binary energetic may be or include a thin wafer provided adjacent the at least one of the divider segments 340'.

Upon detonation of the perforating charges 210, the divider segments 340' may be broken down into debris and spall in a manner substantially similar to the manner in which the divider segments 340 are broken down into debris and spall upon detonation of the perforating charges 210. However, due to their overall thickness and/or geometry, the divider segments 340' may yield a more complete mass of reactants for the shock-induced mixing and activation of the first and second components 316*a* and 316*b* of the binary energetic (as compared to the divider segments 340). An overall axial thickness and/or geometry of the divider segments 340' may be varied, depending on the specific needs of the wellbore. By varying the overall thickness and/or geometry of the divider segments 340', the volume of the gaps 365 may be controlled, thereby allowing an operator to easily select an overall desired free volume of the perforating gun 190. As a result, the free volume of perforating gun 190 can be varied with fine resolution from a minimum free volume to a maximum free volume.

Figure 5C:
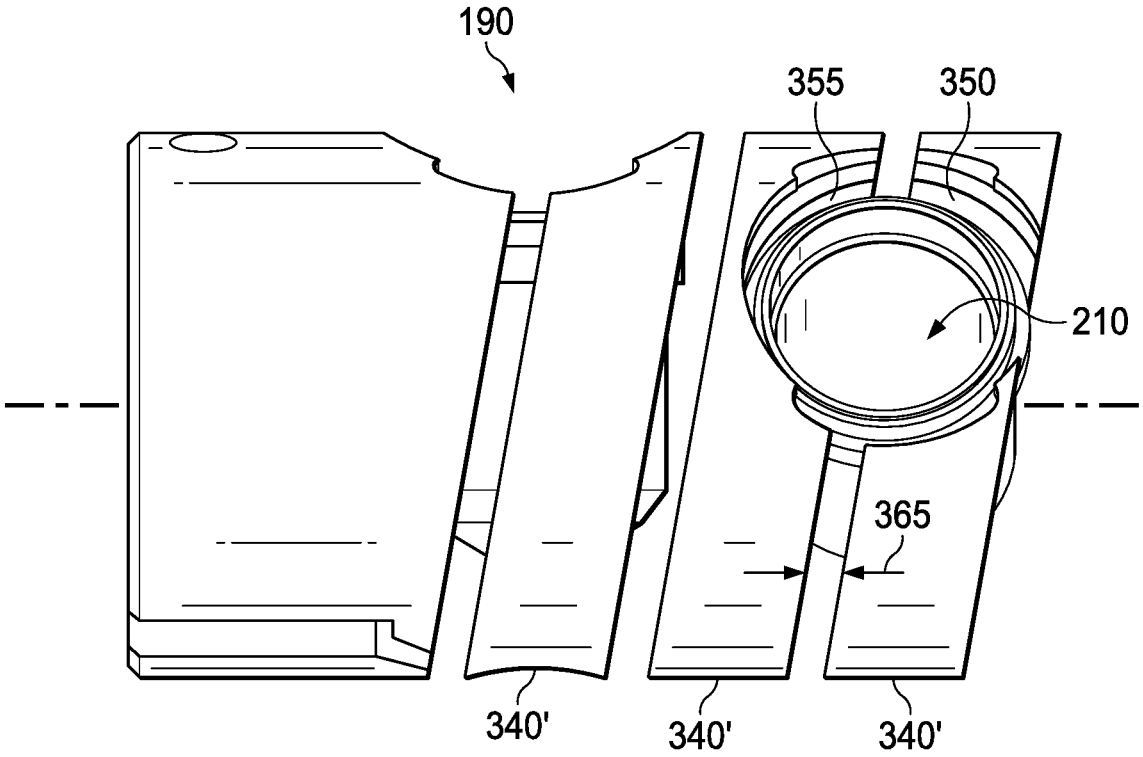
FIG. 5C is an enlarged elevational view of another embodiment of the subdivided divider segments of FIG. 5B in which gaps between the subdivided divider segments extend in an angular orientation relative to the longitudinal axis of the perforating gun, according to one or more embodiments of the present disclosure.

Referring to FIG. 5C, in several embodiments, rather than extending in a perpendicular orientation relative to a longitudinal axis of the perforating gun 190, as shown in FIGS. 5A and 5B, the gaps 365 may instead extend in an angular (e.g., acute and/or obtuse) orientation relative to the longitudinal axis of the perforating gun 190.

Figure 5D:
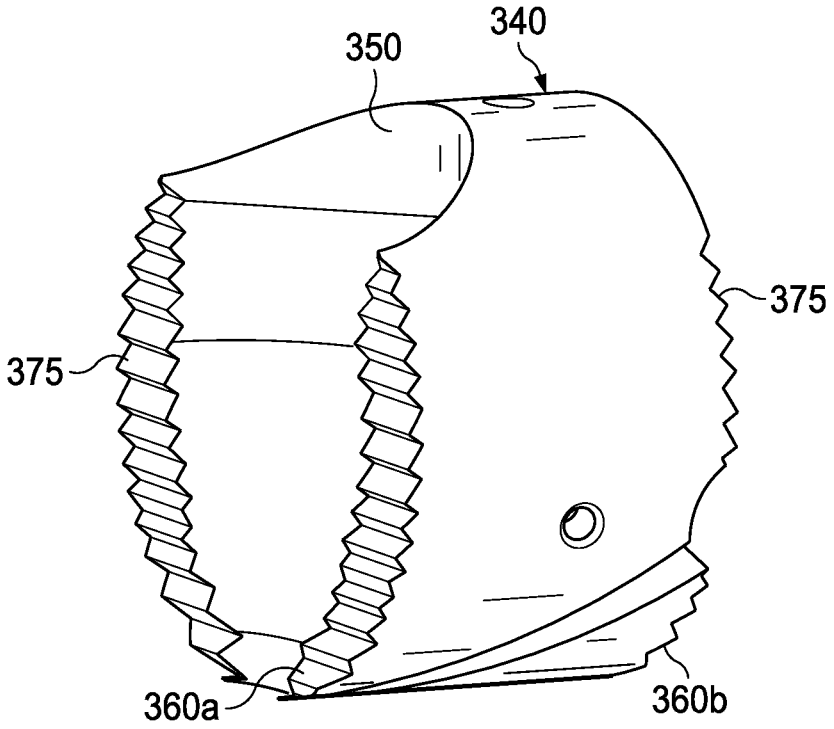
FIG. 5D is an enlarged perspective view of another embodiment in which the divider segments of FIG. 5A each include ridges or saw teeth at opposing end portions thereof, according to one or more embodiments of the present disclosure.
Figure 5E:
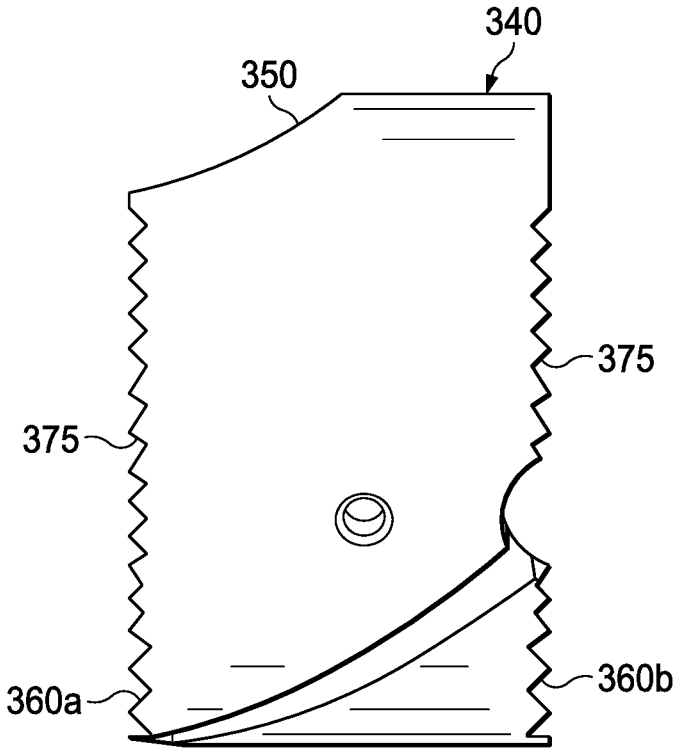
FIG. 5E is an elevational view of the divider segment of FIG. 5D, according to one or more embodiments of the present disclosure.

Referring to FIGS. 5D and 5E, in several embodiments, each of the divider segments 340 may include ridges or saw teeth 375 formed at the respective opposing end portions 360*a* and 360*b* thereof. The saw teeth 375 create microjets to promote the creation of spall from the divider segments 340 upon detonation of the perforating charges 210. More particularly, the saw teeth 375 provide additional surface area at the free surfaces of the divider segments 340 for the shock wave created by detonation of the perforating charges 210 to act on. As a result, the saw teeth 375 enhance spallation and mixing of debris and spalled materials from the divider segments 340.

Figure 6:
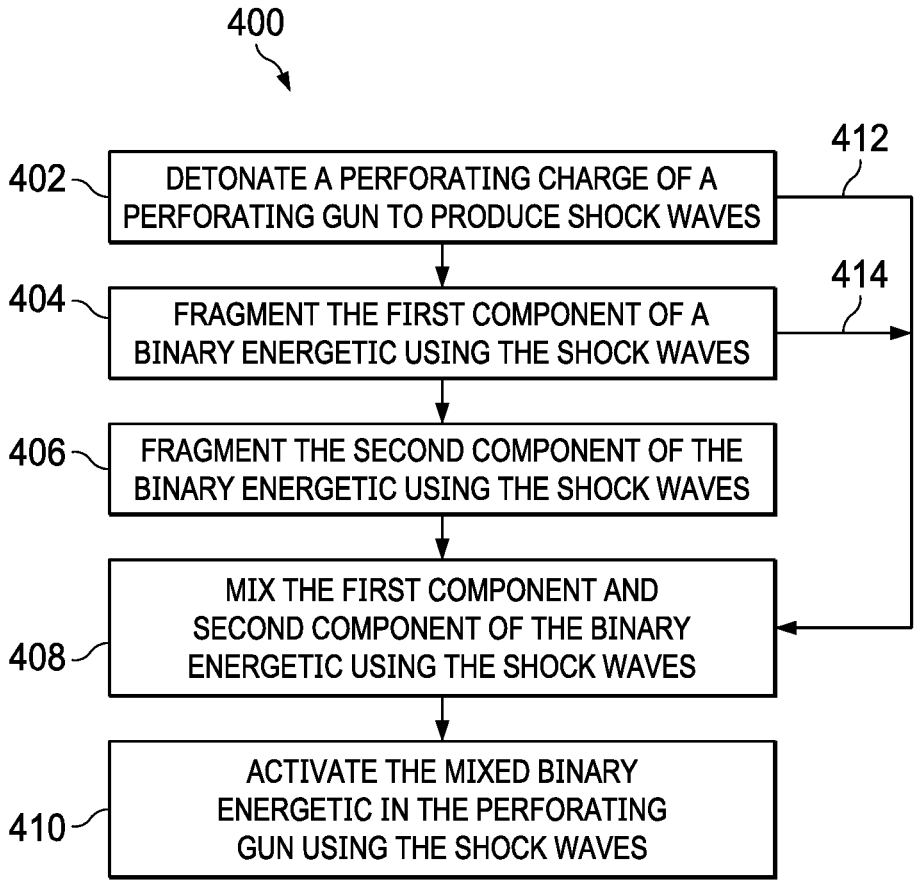
FIG. 6 is a flow diagram of a method for implementing one or more embodiments of the present disclosure.

Referring to FIG. 6, in an embodiment, a method of perforating a wellbore while delaying or decreasing drawdown is generally referred to by the reference numeral 400. The method includes, at a step 402, detonating a perforating charge of a perforating gun to produce shock waves and perforate a wellbore. The perforating charge may comprise a plurality of separate perforating charges. Perforating the wellbore may include perforating: a carrier tube in which the perforating charge is housed, a wellbore casing, cement around the wellbore casing, and/or a subterranean formation. The method 400 also includes, at a step 404, fragmenting a first component of a binary energetic using the shock waves produced by execution of the step 402. The method 400 also includes, at a step 406, fragmenting a second component of the binary energetic using the shock waves produced by execution of the step 402. In this regard, the first component and/or the second component of the binary energetic include(s) physical component(s) of the perforating gun, which physical component(s) fragment into ejecta in response to the shock waves.

The method also includes, at a step 408, mixing the first component and the second component of the binary energetic using the shock waves produced by execution of the step 402. In this regard, the first and second components of the binary energetic may need to be mixed together to properly react. In other words, the first and second components may each be inert in isolation but may form an energetic when mixed together. Finally, the method also includes, at a step 410, activating the mixed binary energetic in the perforating gun using the shock waves produced by execution of the step 402. The binary material may have a threshold energy level below which it does not explode, but above which it does explode. In this regard, the shock waves produced by execution of the step 402 may impart a sufficient level of energy into the binary energetic to activate it (e.g., cause it to explode).

Notably, the steps 404 and 406 may be omitted in some embodiments in which the first and second components of the binary energetic do not require fragmenting as illustrated in FIG. 6 with bypass arrow 412. In this regard, the first component and/or the second component may be stored in the perforating gun in a form that does not require fragmentation to facilitate reactive mixing of the first and second components. For example, each of the first component and the second component may be provided in a granular or powder form. In order to prevent mixing of the first component with the second component before detonation of the perforating charge, the first component and second component may be separated by a wall, membrane, or other feature of the perforating gun (e.g., divider segment) which is cracked, broken, or otherwise damaged by the shock waves when detonation occurs to permit the first and second components to mix. Further, the step 406 may be omitted and the step 404 may be retained in some embodiments in which one of the first and second components requires fragmenting while the other of the first and second components does not require fragmenting for proper mixing, as illustrated in FIG. 6 by bypass arrow 414. For example, the first component of the binary energetic may be provided in the form of one of the physical components of the perforating gun (e.g., the charge tube or the fill body) and the second component may be provided in a granular or powder form.

A perforating gun has been disclosed. The perforating gun generally includes: a perforating charge that is detonable to produce shock waves within the perforating gun; and first and second components of a binary energetic that are mixable and activatable by the shock waves after detonation of the perforating charge to increase an internal energy of the perforating gun. In other embodiments, the perforating gun generally includes: a plurality of perforating charges configured to perforate a wellbore; a plurality of charge cases, each charge case housing one of the plurality of perforating charges; a charge tube housing the plurality of charge cases; a carrier tube housing the charge tube; a fill body comprising a plurality of divider segments aligned longitudinally along a central axis of the perforating gun; a first component of a binary energetic; and a second component of the binary energetic; wherein the first and second components of the binary energetic are mixable and activatable by shock waves from detonation of the plurality of perforating charges.

The foregoing perforating gun embodiments may include one or more of the following elements, either alone or in combination with one another:

- The perforating charge is further detonable to perforate a wellbore proximate a subterranean formation.
- The perforating gun includes a charge tube in which the perforating charge is mounted.
- The charge tube comprises the first component and/or the second component of the binary energetic.

The perforating gun includes a carrier tube in which the charge tube extends.

The carrier tube comprises the first component and/or the second component of the binary energetic.

The perforating gun includes a fill body that is subdivided into at least first and second divider segments, wherein the first divider segment comprises the first component of the binary energetic.

The second divider segment comprises the second component of the binary energetic.

The fill body extends within the charge tube and supports the perforating charge.

The fill body extends within a space defined between the charge tube and the carrier tube.

The perforating charges are configured to perforate a wellbore.

At least one of the plurality of charge cases, the charge tube, the carrier tube, or the fill body comprises the first component of the binary energetic.

At least one of the plurality of charge cases, the charge tube, the carrier tube, or the fill body comprises the second component of the binary energetic.

One of the first and second components of the binary energetic comprises Iron II Oxide ($Fe_2O_3$), Iron II, III Oxide ($Fe_3O_4$), Copper II Oxide (CuO), Manganese Dioxide ($MnO_2$), Manganese III Oxide ($MnO_3$), Molybdenum VI Oxide ($MoO_3$), Aluminum Tantalum, or Bismuth III Oxide ($Bi_2O_3$); and the other of the first and second components of the binary energetic comprises Aluminum (Al) and/or Magnesium (Mg).

The fill body is disposed between the carrier tube and the charge tube; a groove extends along an outer surface of the fill body; and a detonation cord is disposable within the groove for initiating the perforating charges.

The fill body is disposed within the charge tube; and each of the divider segments comprises a cavity for housing a portion of one of the plurality of charge cases.

A method has also been disclosed. The method generally includes: detonating a perforating charge of a perforating gun to produce shock waves within the perforating gun and to perforate a wellbore proximate a subterranean formation; and after detonating the perforating charge, utilizing the shock waves to activate a binary energetic in the perforating gun.

The foregoing method embodiment may include one or more of the following elements, either alone or in combination with one another:

- Detonating the perforating charge perforates a wellbore proximate a subterranean formation.
- The binary energetic comprises first and second components each comprising a substance that is inert in isolation but reactive when mixed with the other of the first and second components.
- The method includes after detonating the perforating charge and before activating the binary energetic, utilizing the shock waves to mix the first and second components of the binary energetic.
- The method includes after detonating the perforating charge and before mixing the binary energetic, utilizing the shock waves to fragment at least one of the first and second components of the binary energetic.
- Activating the binary energetic in the perforating gun increases an internal energy of the perforating gun; and the method further comprises utilizing the internal energy to delay and/or decrease pressure drawdown within the wellbore It is understood that variations may be made in the foregoing without departing from the scope of the present disclosure.

In several embodiments, the elements and teachings of the various embodiments may be combined in whole or in part in some or all of the embodiments. In addition, one or more of the elements and teachings of the various embodiments may be omitted, at least in part, and/or combined, at least in part, with one or more of the other elements and teachings of the various embodiments.

Any spatial references, such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described above.

In several embodiments, while different steps, processes, and procedures are described as appearing as distinct acts, one or more of the steps, one or more of the processes, and/or one or more of the procedures may also be performed in different orders, simultaneously and/or sequentially. In several embodiments, the steps, processes, and/or procedures may be merged into one or more steps, processes and/or procedures.

In several embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several embodiments have been described in detail above, the embodiments described are illustrative only and are not limiting, and those skilled in the art will readily appreciate that many other modifications, changes and/or substitutions are possible in the embodiments without materially departing from the novel teachings and advantages of the present disclosure. Accordingly, all such modifications, changes, and/or substitutions are intended to be included within the scope of this disclosure as defined in the following claims. In the claims, any means-plus-function clauses are intended to cover the structures described herein as performing the recited function and not only structural equivalents, but also equivalent structures. Moreover, it is the express intention of the applicant not to invoke 35 U.S.C. § 112, paragraph 6 for any limitations of any of the claims herein, except for those in which the claim expressly uses the word "means" together with an associated function.

What is claimed is:

1. A perforating gun, comprising:

a perforating charge that is detonable to produce shock waves within the perforating gun; and first and second components of a binary energetic positioned in the perforating gun;

wherein the perforating gun is actuable from:

a first configuration, in which:

the perforating charge is undetonated; and the first and second components of the binary energetic are unmixed:

to a second configuration, in which:

the perforating charge is detonated; and the first and second components of the binary energetic are mixed by the shock waves produced from detonation of the perforating charge;

and a third configuration, in which the mixed first and second components of the binary energetic are activated in the perforating gun to increase an internal energy of the perforating gun.

2. The perforating gun of claim 1, further comprising:

a charge tube in which the perforating charge is mounted.

3. The perforating gun of claim 2, wherein the charge tube comprises the first component and/or the second component of the binary energetic.

4. The perforating gun of claim 2, further comprising:

a carrier tube in which the charge tube extends.

5. The perforating gun of claim 4, wherein the carrier tube comprises the first component and/or the second component of the binary energetic.

6. The perforating gun of claim 4, further comprising:

a fill body that is subdivided into at least first and second divider segments, wherein the first divider segment comprises the first component of the binary energetic.

7. A perforating gun, comprising:

a perforating charge that is detonable to produce shock waves within the perforating gun;

first and second components of a binary energetic that are mixable and activatable by the shock waves after detonation of the perforating charge to increase an internal energy of the perforating gun;

a charge tube in which the perforating charge is mounted;

a carrier tube in which the charge tube extends; and a fill body that is subdivided into at least first and second divider segments, wherein the first divider segment comprises the first component of the binary energetic;

wherein the second divider segment comprises the second component of the binary energetic.

8. A perforating gun, comprising:

a perforating charge that is detonable to produce shock waves within the perforating gun;

first and second components of a binary energetic that are mixable and activatable by the shock waves after detonation of the perforating charge to increase an internal energy of the perforating gun;

a charge tube in which the perforating charge is mounted;

a carrier tube in which the charge tube extends; and a fill body that is subdivided into at least first and second divider segments, wherein the first divider segment comprises the first component of the binary energetic;

wherein the fill body extends within the charge tube and supports the perforating charge.

9. A perforating gun, comprising:

a perforating charge that is detonable to produce shock waves within the perforating gun;

first and second components of a binary energetic that are mixable and activatable by the shock waves after detonation of the perforating charge to increase an internal energy of the perforating gun;

a charge tube in which the perforating charge is mounted;

a carrier tube in which the charge tube extends; and a fill body that is subdivided into at least first and second divider segments, wherein the first divider segment comprises the first component of the binary energetic;

wherein the fill body extends within a space defined between the charge tube and the carrier tube.

10. A perforating gun, comprising:

a plurality of perforating charges;

a first component of a binary energetic; and a second component of the binary energetic;

wherein the perforating gun is actuable from:

a first configuration, in which:

the perforating charges are undetonated; and the first and second components of the binary energetic are unmixed;

to a second configuration, in which:

at least one of the plurality of perforating charges is detonated; and the first and second components of the binary energetic are mixed in the perforating gun by shock waves from detonation of the at least one of the plurality of perforating charges;

and a third configuration, in which the mixed first and second components of the binary energetic are activated in the perforating gun to increase an internal energy in the perforating gun.

11. The perforating gun of claim 10, wherein the first component of the binary energetic comprises:

at least one of a plurality of charge cases, each of the charge cases housing one of the plurality of perforating charges;

a charge tube housing the plurality of charge cases;

a carrier tube housing the charge tube; or at least one of a plurality of divider segments of a fill body, the divider segments being aligned longitudinally along a central axis of the perforating gun.

12. The perforating gun of claim 11, wherein the second component of the binary energetic comprises:

at least another one of the plurality of charge cases;

the charge tube;

the carrier tube; or at least another one of the plurality of divider segments of the fill body.

13. The perforating gun of claim 11, wherein:

one of the first and second components comprises Iron II Oxide ($Fe_2O_3$), Iron II, III Oxide ($Fe_3O_4$), Copper II Oxide (CuO), Manganese Dioxide ($MnO_2$), Manganese III Oxide ($MnO_3$), Molybdenum VI Oxide ($MoO_3$), Aluminum Tantalum, or Bismuth III Oxide ($Bi_2O_3$); and the other of the first and second components of the binary energetic comprises Aluminum (Al) or Magnesium (Mg).

14. The perforating gun of claim 13, wherein the fill body is disposed between the carrier tube and the charge tube;

wherein a groove extends along an outer surface of the fill body; and wherein a detonation cord is disposable within the groove for initiating the perforating charges.

15. The perforating gun of claim 13, wherein the fill body is disposed within the charge tube; and wherein each of the divider segments comprises a cavity for housing a portion of one of the plurality of charge cases.

16. A method, comprising:

detonating a perforating charge of a perforating gun to produce shock waves within the perforating gun;

after detonating the perforating charge, mixing, using the shock waves, a binary energetic in the perforating gun; and after mixing the binary energetic in the perforating gun, activating the binary energetic in the perforating gun.

17. The method of claim 16, wherein the binary energetic comprises first and second components each comprising a substance that is inert in isolation but reactive when mixed with the other of the first and second components.

18. The method of claim 17, further comprising:

after detonating the perforating charge and before mixing the binary energetic, fragmenting, using the shock waves, at least one of the first and second components of the binary energetic.

19. The method of claim 16, wherein activating the binary energetic in the perforating gun increases an internal energy of the perforating gun; and wherein the method further comprises delaying and/or decreasing, using the internal energy, pressure draw-down within the wellbore.

* * * * *